US008841244B2

(12) United States Patent
Malmstedt et al.

(10) Patent No.: US 8,841,244 B2
(45) **Date of Patent: *Sep. 23, 2014**

(54) USE OF A LUBRICANT

(75) Inventors: Ebbe Malmstedt, Göteborg (SE); Walter Holweger, Epfendorf (DE); Hubertus Peek, Gaastmeer (NL); Ingemar Strandell, Savedalen (SE); Arno Stubenrauch, Aidhausen (DE); Bernhard Bauer, Hassfurt (DE); Frank Fiddelaers, Ijsselstein (NL); Albert Van Den Kommer, Nieuwegein (NL)

(73) Assignee: AB SKF, Gothenburg (SE)

( * ) Notice: Subject to any disclaimer, the term of this patent is extended or adjusted under 35 U.S.C. 154(b) by 1820 days.

This patent is subject to a terminal disclaimer.

(21) Appl. No.: 11/720,607

(22) PCT Filed: Nov. 23, 2005

(86) PCT No.: PCT/EP2005/012512

§ 371 (c)(1), (2), (4) Date: Feb. 19, 2010

(87) PCT Pub. No.: WO2006/058637

PCT Pub. Date: Jun. 8, 2006

(65) Prior Publication Data

US 2010/0152075 A1 Jun. 17, 2010

(30) Foreign Application Priority Data

Dec. 3, 2004 (EP) ..... 04028638

(51) Int. Cl.
*C10M 169/06* (2006.01)
*C10M 133/16* (2006.01)

(52) U.S. Cl.
CPC ..... *C10M 169/06* (2013.01); *C10M 2223/06* (2013.01); *C10M 2223/042* (2013.01); *C10M 2215/1026* (2013.01); *C10N 2210/02* (2013.01); *C10N 2240/02* (2013.01); *C10M 2217/0456* (2013.01); *C10N 2210/06* (2013.01); *C10N 2210/01* (2013.01); *C10M 2205/0265* (2013.01); *C10N 2210/05* (2013.01); *C10M 2203/003* (2013.01); *C10M 2201/087* (2013.01); *C10M 2215/223* (2013.01); *C10M 2201/08* (2013.01); *C10N 2250/10* (2013.01); *C10M 2207/0285* (2013.01); *C10M 2223/043* (2013.01); *C10M 133/16* (2013.01); *C10M 2215/12* (2013.01); *C10M 2219/06* (2013.01); *C10M 2219/066* (2013.01); *C10M 2215/08* (2013.01); *C10M 2207/026* (2013.01); *C10M 2207/12* (2013.01); *C10N 2230/06* (2013.01)
USPC ..... 508/528; 508/158

(58) Field of Classification Search
USPC ..... 508/158, 436, 528
See application file for complete search history.

(56) References Cited

U.S. PATENT DOCUMENTS 2,479,890 A * 8/1949 Adams ..... 8/664
3,609,149 A * 9/1971 Matsui et al. ..... 544/193

(Continued)

FOREIGN PATENT DOCUMENTS

EP 0386653 B1 9/1990
JP 2003193080 A * 7/2003
JP 2003321692 11/2003

*Primary Examiner* — James Goloboy
(74) *Attorney, Agent, or Firm* — Harness, Dickey & Pierce, PLC

(57) ABSTRACT

A use of a lubricant comprising at least one reaction product of mono-di- and/or poly-isocyanate with unbranced and/or branced, unsaturated and/or saturated, alicyclic poly-amine with carbon numbers from 5 to 24, at least between at lease two elements, which are movable against each other.

22 Claims, 5 Drawing Sheets

(56) References Cited

U.S. PATENT DOCUMENTS

| | | | | | |
|---|---|---|---|---|---|
| 4,575,431 | A | * | 3/1986 | Salentine | 508/159 |
| 4,929,371 | A | * | 5/1990 | Waynick | 508/159 |
| 5,102,565 | A | | 4/1992 | Waynick | |
| 5,331,024 | A | * | 7/1994 | Brink et al. | 523/200 |
| 5,916,853 | A | | 6/1999 | Hamori et al. | |
| 6,020,290 | A | * | 2/2000 | Takata et al. | 508/364 |
| 2002/0099155 | A1 | * | 7/2002 | Inoue et al. | 526/172 |
| 2003/0069147 | A1 | * | 4/2003 | Kawamura et al. | 508/555 |
| 2004/0242439 | A1 | | 12/2004 | Mikami et al. | |
| 2006/0052257 | A1 | | 3/2006 | Kinoshita et al. | |

* cited by examiner

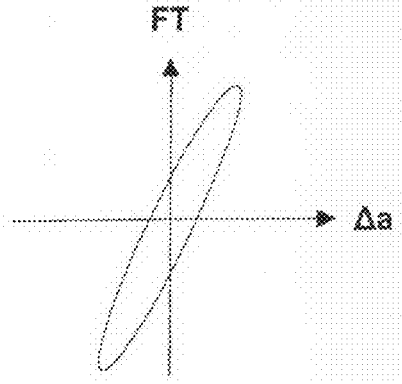
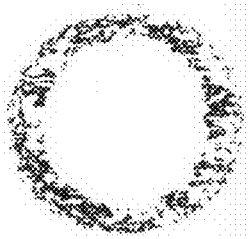
FIG 2a
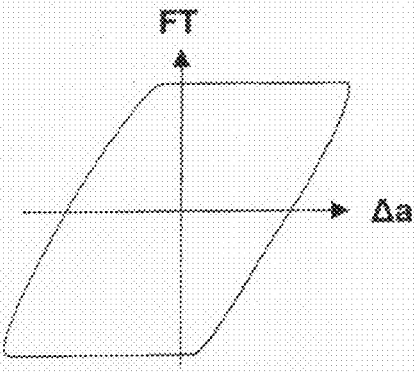
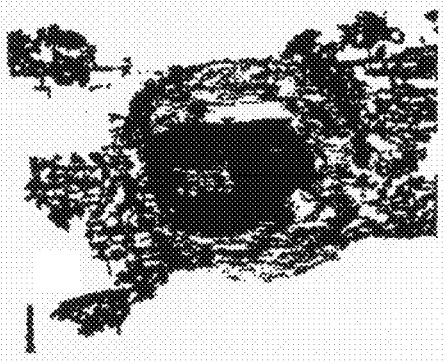
FIG 2b

USE OF A LUBRICANT

This invention concerns a use of a lubricant.

BACKGROUND

Greases are widely used in lubrication of bearings and other structural components. An effect called false brinelling occurs in the circumstances with relatively small displacements between rolling parts and the raceway of the bearing rings, whereby false brinelling is found in incomplete contacts. Further, an effect called fretting is found in complete contacts. Fretting relates to bearing seat interfaces of which the mating surfaces are oscillating at small amplitudes. False brinelling and fretting can result in considerable damage. Up to now, commercially available greases particularly in rolling bearings are lacking in protection against false brinelling and fretting.

So one problem addressed by the present invention is to find a suitable lubricant for a use between two elements being movable against each other, so that the elements are also protected against false brinelling and fretting.

Thereby the invention is based on the cognition, that the lubricant according to the present invention provides a lubricant having well-performing properties in conventional bearing operation (over rolling) also provides excellent anti-false brinelling properties and protects mating components against fretting and fretting corrosion.

Furthermore the invention is based on the cognition, that grease lubrication functions well at relatively large amplitude oscillations. At smaller displacement amplitudes greases face severe difficulties to provide proper lubrication to the mating surfaces. It has been found that the phosphate coating is not sufficient for preventing false brinelling. Thereby adhesion of phosphates is insufficient resulting in premature removal from the rolling bearing component. So the phosphate layer will simply be wiped away during the first oscillations and after that there is no lubrication to prevent damage to the related parts. The phosphate layer with grease lubrication will not offer sufficient protection against false brinelling especially not in the so-called partial slip regime.

SUMMARY

The lubricant according to the present invention very quickly releases the curing elements against false brinelling and fretting and provides simultaneously a physical and chemical interaction with the mating surface(s) thereby providing proper lubrication against fretting and false brinelling. The lubricant also has a long lasting bearing grease life according to industrial standards. Greases are widely applied to the contact between rolling elements and bearing raceways and bearing cages to provide long lasting lubrication. Up to now commercially available greases have not had the capability to lubricate small oscillating contacts.

Because of the excellent lubricating properties of the lubricant according to the invention, the grease functions properly at small and large amplitudes i.e. displacements. According to the invention the grease or paste—a paste comprises a base oil and a thickener like a grease, but has no structure—applied on one of the bearing component surfaces or any other surfaces of structural components like e.g. gears, has excellent lubricating properties even in harsh conditions as found in fretting and false brinelling. In contrast thereto other means of lubrication, coatings, pastes, oils or greases only offer little protection against false brinelling. The subject of the invention in the form of a paste applied at the bearing seat contacts, ring-on-axle, ring-in-housing, side faces of the bearing rings etc., has excellent lubricating properties in fretting conditions. In contrast thereto other means of lubrication, coatings, pastes, oils or greases offer little protection against fretting the mating structural surfaces.

The lubricant according to the present invention protects bearing surfaces during the first oscillations and the lubricant in form of a grease for false brinelling and/or in form of a grease or paste for fretting offers continuous low friction.

DRAWINGS

Further advantages, features and details of the invention are described in the following on the basis of preferred embodiments of the invention in connection with the Figures. Thereby the Figures show:

FIG. 1 is a diagram of different contact conditions between two mating elements;

FIG. 2*a* is a specific shape of a fretting loop for a partial slip regime and a corresponding wear mark concerning a ball-on-flat contact configuration;

FIG. 2*b* is a specific shape of a fretting loop for a gross slip regime and a corresponding wear mark concerning a ball-on-flat contact configuration;

FIG. 3 are fretting loops as function of oscillating cycles;

DETAILED DESCRIPTION

Figure 1:
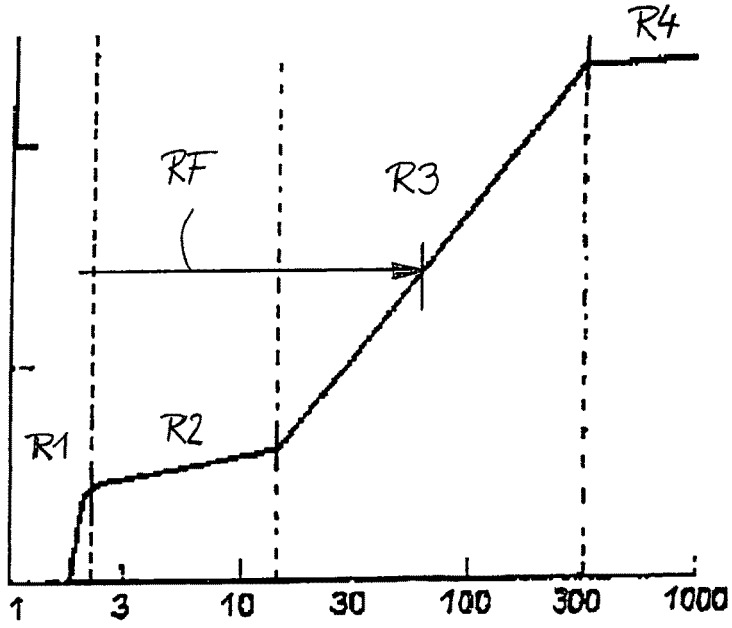

In various embodiments, a lubricant composition comprises at least one reaction product of a mono-, di- and/or poly-isocyanate with unbranched and/or branched, unsaturated and/or saturated, alicyclic poly-amine with carbon numbers from 5 to 24. The composition is used in methods of lubricating a lubricating system comprising at least two elements that are moveable against one another by applying the composition to the lubricating system.

In various embodiments, the lubricant composition further comprises a carboxylic acid amide which is based on aliphatic unbranched, alicyclic and/or aromatic chains with lengths from 2 to 60 carbon atoms and/or a magnesium, calcium, bismuth and/or alkylammonium salt of said carboxylic acid amide. The carboxylic acid amide can be a monoamide or a polyamide.

In one aspect, the lubricant composition is provided in the form of a grease or paste, and is used in a method involving applying the composition to a lubricating system. In various embodiments, the lubricating system comprises at least two elements that are movable against one another. Examples of such elements include ball bearings; tapered, needle, cylindrical, and spherical rolling bearings, and universal joint bearings. In various embodiments, the bearings comprise seal means for holding the lubricant composition inside the bearing. In various embodiments, one of the elements is a bearing rolling element and another element comprises a raceway for the rolling element.

In various embodiments, the lubricant composition contains one or more of the additives described below.

An oil for the lubricant is based on aliphatic unbranched and/or branched, alicyclic and/or aromatic hydrocarbon with chain lengths from 10 to 1000 carbon atoms, or is based on a mono-, di-, and/or polycarboxylic ester oil. The ester oil is based on aliphatic unbranched and/or branched, alicyclic and/or aromatic carboxylic acid with carbon range from 3 to 100 carbon atoms, and aliphatic unbranched and/or branched, alicyclic and/or aromatic alcohol with a carbon range from 3 to 100 carbon atoms.

Further, the lubricant can contain a mono- or polyphosphoric acid and/or phosphoric acid derivative, such as alkylphosphoric acid with chain lengths from 4 to 20 carbon atoms, or a phosphoric acid alkyloxy derivative, whereby the phosphoric acid and/or derivatives are neutralized by aliphatic unbranched and/or branched and/or alicyclic alkylamine with chain lengths from 4 to 24 carbon atoms.

In various embodiments, the lubricant composition, preferably in the form of a grease or paste, contains a monocarboxylic or polycarboxylic acid of aliphatic unbranched and/or branched, alicyclic and/or aromatic chains with lengths from 2 to 100 carbon atoms for the monocarboxylic acid and with 4 to 12 carbon atoms for the polycarboxylic acid, and/or a lithium, potassium, magnesium, zinc, or calcium salt of said carboxylic acid and/or its derivative.

Further additives include a lithium, potassium, magnesium, calcium, zinc, bismuth and/or alkylammonium salt of an inorganic acid, such as mono-, di- and/or poly-phosphoric acid additive and/or its derivative with aliphatic unbranched and/or branched and/or cyclic alkyl chains with lengths from 4 to 30 carbon atoms, whereby the acid and/or the derivative is neutralized by aliphatic unbranched and/or branched and/or alicyclic alkyl amine group and/or aromatic amine ring group.

Further additives include a molybdenum compound, such as molybdato acid and/or molybdatotungsten acid; a vanadium compound; and boric acid or a boric acid derivative.

Further, the composition can contain at least one of triphenylphosphorothionate and/or its alkyl derivative with branched alkyl group from 10 to 14 carbon atoms; a carbon-nitrogen and sulphur additive, represented by mercaptodithiazole, its derivative, or its sodium salt; benzotriazole and/or its derivative; polymeric hydroquinone derivative; and sterically hindered phenol and/or its derivative and/or salt of thiocarbamic acid derivative and/or dithiophosphoric acid derivative with chain lengths from 4 to 12 carbon atoms, whereby the acids are neutralized by amine with chain lengths from 4 to 24 carbon atoms.

FIG. 1 shows different contact conditions between a rolling element and its bearing ring. Thereby the stress distribution for the rolling element on the bearing ring is characterized by a maximum pressure in the center of the contact of the two mating components. The friction will thus be highest in the center of the contact and will decrease towards the outer contact region where the pressure is reduced.

In FIG. 1, the horizontal axis indicates a displacement in μm and the vertical axis a wear. A first contact condition is the so-called sticking regime R1. Thereby at even smaller displacement amplitudes (very small tangential forces relatively to the normal loads) the contact is accommodated fully by elastic deformation over the whole contact area and no slip is occurring.

Next to the regime R1 the so-called partial slip regime or stick-slip regime R2 follows. Introducing a tangential force will show a maximum shear stress at the outer annular region and minimum shear stresses at the center of the contact. Slip will occur when the shear force is able to overcome the frictional force, which first occurs in the outer region of the contact. The high contact pressure in the center of the contact and consequently the high friction prevents slip when the tangential force is limited. Therefore sticking occurs in the center of the contact and slip occurs in the outer region. In the partial slip regime R2 some of the energy is dissipated through sliding and a part by elastic and plastic deformation of the asperities and the mating materials.

Then a so-called gross slip regime R3 follows, which is characterized by slip over the whole contact area. When the tangential force is increased in the partial slip regime R2 (at increasing displacement amplitude), the stick circle decreases to zero in size and at this point the condition of partial slip transforms into gross slip. Last but not least the gross slip regime R3 passes into the so-called reciprocating sliding regime R4.

A wear mechanism occurring between two mating surfaces at small amplitude oscillating motions is called fretting. Fretting corrosion or damage occurring to the contacting surfaces between the rolling elements and the bearing ring are called false brinelling. Therefore, the terminology false brinelling is only used for rolling elements experiencing small oscillating movements relatively to the bearing rings. The terminology fretting is used for all kinds of contact configurations like those found in false brinelling and flat-on-flat contacts or bearing seats. Common oscillating amplitudes in false brinelling and fretting are less then 100 μm. In false brinelling of such small displacements the rolling motion is not always ensured and displacement can be based on sticking elastic and plastic deformation at the contact with or without slip and/or sliding. Generally three kinds of fretting and false brinelling can be distinguished: Sticking, partial slip and gross slip regime, R1, R2 and R3 respectively, as described above.

Further in FIG. 1 an arrow RF marks the fretting region that has been the problematic region for commercially available greases and is also the region wherein the grease according to the invention brings great advantages. As indicated by FIG. 1, the region covers not only the partial slip regime R2 but also part of the gross slip regime R3. So in view of FIG. 1 the region can be expressed by a maximum wear rate value. There are various other ways possible to describe the region, whereby dimensionless fretting regime parameter, energy parameter, contact area parameter and/or a displacement parameter can be used. In a more general way the region can also be specified in terms of oscillating amplitude.

In another terminology tribological contacts are frequently described by the terminologies "complete and incomplete" contacts. An incomplete contact refers to mating surfaces of which the contact area increases with increasing contact load, i.e. the contact area dimension is dependent on the load level. A false brinelling contact, rolling element on bearing raceway, is an example of an incomplete contact. The contact area is constant in case of complete contacts independent of contact load. A bearing seat contact is an example of a complete contact. The subject invention protects any mating surfaces from fretting and false brinelling in incomplete and complete contacts for relatively partial and gross slip conditions, whereby their appearance is promoted in connection with loose fit or interference fit bearing seats. Anti-fretting pastes are used in various applications as a low cost solution to resist fretting at bearings seats. However, such pastes do not have satisfying resistance to fretting and the conditions found at bearing seats. The performance of pastes is limited in partial slip conditions at bearing seats.

FIG. 2*a* shows a specific shape of a fretting loop for a partial slip regime R2 and a corresponding wear mark concerning a ball-on-flat contact configuration. In general, fretting loops are used to determine the fretting regime for specific contact conditions giving a deep understanding of the failure mode and material response to the applied conditions. Fretting loops are representations of tangential force FT versus displacement amplitude [Δa] as the case may be as function of time. Thereby in FIG. 2*a* the horizontal axis indicates the displacement amplitude [Δa] and the vertical axis the tangential force FT, whereby no time dependency is included. The partial slip regime R2 can be identified by a nearly closed loop as shown in the graph of FIG. 2*a* and by the typical contact area having an outer slip circle and an inner sticking area as shown in the picture of FIG. 2*a*.

FIG. 2*b* shows a specific shape of a fretting loop for a gross slip regime R3 and a corresponding wear mark. Otherwise the description concerning FIG. 2*a* applies in a similar way. The gross slip regime R3 is identified by an open loop as shown in the graph of FIG. 2*b* and by slip over the whole contact area as shown in the picture of FIG. 2*b*. The same philosophy can be applied for other contact configurations like ball-on-ring, roller-on-ring, flat on flat, bearing seats etc.

FIG. 3 shows fretting loops as function of oscillating cycles OC from left to right for a partial slip regime R2, a mixed slip regime and a gross slip regime R3. So FIG. 3 shows a development of a fretting contact as a function of time namely the oscillating cycles OC.

Figure 4:
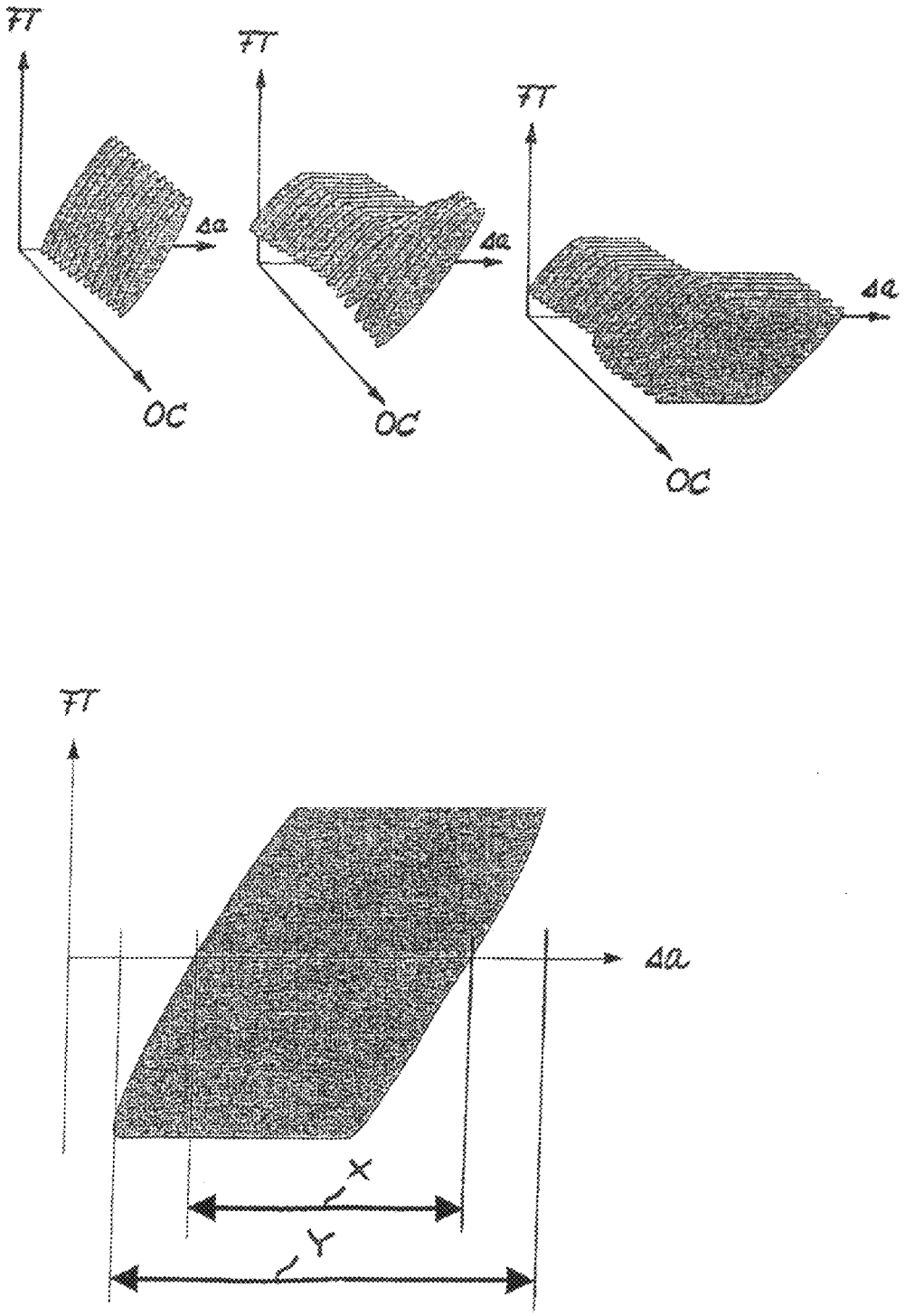
FIG. 4 is a fretting loop illustrating a definition of a dimensionless fretting regime parameter.

FIG. 4 shows a fretting loop illustrating the definition of a dimensionless fretting regime parameter Z, which is independent of the type of regime and is the quotient (Z=X/Y) of the two displacement ranges X and Y. Thereby a zero value of Z represents a pure elastic sticking regime R1 and a unity value represents full sliding without sticking.

Figure 5:
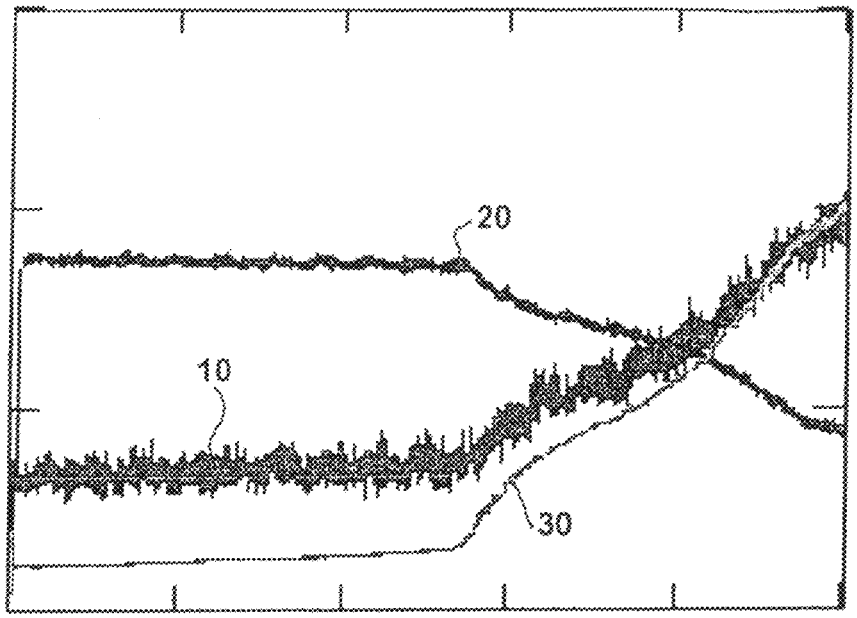
FIG. 5 depicts test results obtained in false brinelling conditions with a commercially available grease.
Figure 6:
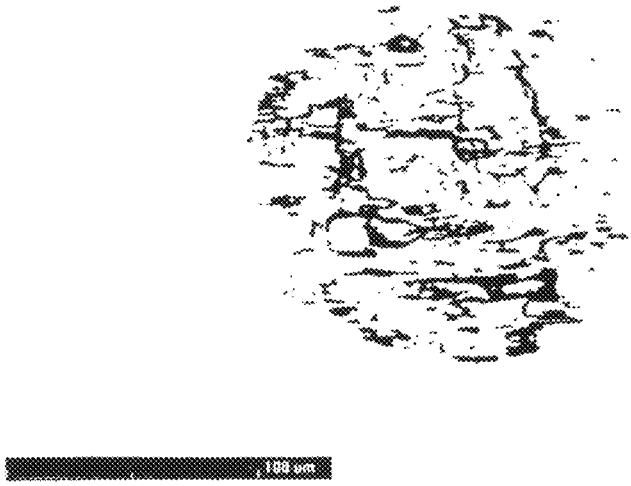
FIG. 6 is a produced damaged surface according to FIG. 5.

FIG. 5 shows test results obtained in false brinelling conditions with a commercially available grease. Thereby a bearing rolling element was oscillated in contact with a fixed flat bearing steel surface. The test has been performed under constant actuating force and constant frequency. The test results were obtained in false brinelling conditions at 1 GPa, 20 Hz and amplitude of 20 μm. The horizontal axis indicates the number of fretting cycles. Thereby curve 10 indicates the wear, curve 20 the displacement and curve 30 the friction coefficient. The rising of the wear and the friction coefficient curve indicates a bad performance and a quick incidence of a failure. FIG. 6 shows a damaged surface according to FIG. 5.

Figure 7:
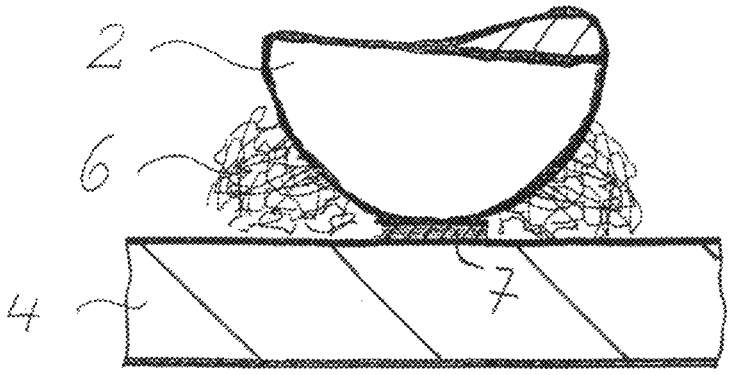
FIG. 7 illustrates a protective layer of a lubricant according to the invention between two structural components.

FIG. 7 shows as one structural component 2 one half of a rolling element and as a second structural component 4 a raceway for said rolling element. Further there is a grease 6 present forming a protective layer 7 during oscillating motions locally between the mating surfaces of the rolling element and the raceway. Thereby the grease 6 modifies the surface of the structural components 2 and 4 comprising a reaction product wherein said product has been provided by chemical reaction between the grease 6 and the structural components 2 and 4, so that said product has lubricating properties from at least −4O<0>C to +200<0>C. Further the grease 6 or more precisely said product forms a lubricating layer 7 producing on top of the mating surface (s) a coating having a thickness of less than 5 μm and in particular less than 2 μm, and more particular about 1 μm. By choosing such thickness the internal bearing clearance is not affected.

Figure 8:
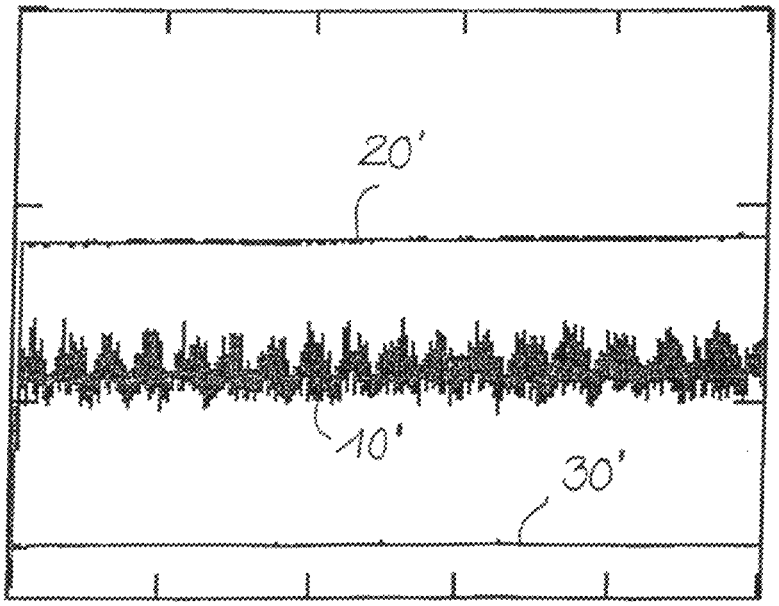
FIG. 8 depicts the result obtained in false brinelling tests with the subject invention grease or paste.

FIG. 8 shows test results obtained in false brinelling with subject invention grease or paste. Thereby a bearing rolling element was oscillated in contact with a fixed flat bearing steel surface. The test has been performed under constant actuating force and constant frequency. Thereby the test results were obtained in false brinelling conditions at 1 GPa, 20 Hz and amplitude of 20 μm. Similar as in FIG. 5 the horizontal axis indicates the number of fretting cycles wherein curve 10' indicates the wear, curve 20' the displacement and curve 30' the friction coefficient.

In contrast to FIG. 5, the constant wear and the friction coefficient indicates an excellent performance. So the rapid increase in friction of FIG. 5 in the partial slip regime is prevented.

One example of a grease in accordance with the teachings of the present invention includes 85% by weight polyisobutene with an average mol weight 10 000 atomic mass units, 1% by weight bicyclo[2.2.1]heptane-1,3-diamine, 4% by weight 9,10-octadecenylamine, 4% by weight isophorone-diisocyanate, 3% by weight triphenylphosphorothionate and 2% by weight 4-butyloctaneammonium 2-ethylhexyl phosphate.

What is claimed is:

1. A method of lubricating a system comprising two elements moveable against each other, the method comprising applying a lubricant composition to the system, wherein the composition comprises:

a reaction product of a mono-, di- or poly-isocyanate and an unbranched or branched, unsaturated or saturated, or alicyclic poly-amine with carbon numbers from 5 to 24, and a bismuth or alkylammonium salt of a carboxylic acid amide which is based on aliphatic unbranched, alicyclic or aromatic chains with lengths from 2 to 60 carbon atoms.

2. The method according to claim 1, wherein the lubricant comprises at least one of:

oil, based on aliphatic unbranched and/or branched, alicyclic or aromatic hydrocarbon with chain lengths from 10 to 1000 carbon atoms; and mono-, di-, or polycarboxylic ester oil, based on aliphatic, unbranched or branched, alicyclic or aromatic carboxylic acid with carbon range from 3 to 100 carbon atoms, and aliphatic, unbranched or branched, alicyclic or aromatic alcohol with a carbon range from 3 to 100 carbon atoms.

3. The method according to claim 1, wherein the lubricant composition comprises an alkylammonium salt of:

a) monophosphoric acid;

b) polyphosphoric acid;

c) phosphoric acid derivative;

d) alkylphosphoric acid with chain lengths from 4 to 20 carbon atoms; or e) phosphoric acid alkyloxy derivative;

whereby the phosphoric acid or derivatives are neutralized by aliphatic, unbranched or branched, or alicyclic alkylamine with chain lengths from 4 to 24 carbon atoms.

4. The method according to claim 1, wherein the lubricant composition comprises at least one of:

a) monocarboxylic acid with chain length from 2 to 100 carbon atoms;

b) polycarboxylic acid with chain lengths from 4 to 12 carbon atoms; and c) lithium, potassium, magnesium, zinc, or calcium salt of said carboxylic acids.

5. The method according to claim 1, wherein the lubricant composition comprises a lithium, potassium, magnesium, calcium, zinc, bismuth or alkylammonium salt, wherein the salt is of:

a) an inorganic acid;

b) diphosphoric acid;

c) polyphosphoric acid; or d) phosphoric acid derivative with aliphatic, unbranched or branched, or cyclic alkyl chains with lengths from 4 to 30 carbon atoms.

6. The method according to claim 1, wherein the lubricant composition comprises at least one of:
molybdenum compound;
molybdato acid;
molybdatotungsten acid;
vanadium compound;
boric acid and;
boric acid derivative.

7. The method according to claim 1, wherein the lubricant composition comprises at least one of:
triphenylphosphorothionate;
phosphorothionate alkyl derivative with branched alkyl group from 10 to 14 carbon atoms;
carbon-nitrogen and sulphur additive;
mercaptodithiazole or derivatives or sodium salts thereof;
benzotriazole;
benzotriazole derivative;
polymeric hydroquinone derivative;
sterically hindered phenol;
sterically hindered phenol derivative;
salt of a thiocarbamic acid derivative with chain length of 4 to 12 carbons; and
salt of a dithiophosphoric acid derivative with chain lengths from 4 to 12 carbon atoms;
wherein the acids are neutralized by amine with chain lengths from 4 to 24 carbon atoms.

8. The method according to claim 1, wherein the lubricant composition is in the form of a grease or paste.

9. The method according to claim 1, wherein the two elements are selected from a ball bearing, a tapered, needle, cylindrical or spherical rolling bearing, and a universal joint bearing.

10. The method according to claim 9, wherein the bearing comprises seal means for holding the lubricant inside the bearing.

11. The method according to claim 1, wherein one of the two elements is a bearing rolling element and the other element is a raceway for said rolling element.

12. A method of lubricating a system comprising two elements movable against each other, the method comprising applying a lubricant composition to the system, wherein the composition comprises:
a reaction product of a mono-, di- or polyisocyanate and an unbranched or branched, unsaturated or saturated, or alicyclic polyamine with carbon numbers from 5 to 24; and
a magnesium, calcium, bismuth, or alkylammonium salt of a carboxylic acid amide which is based on aliphatic unbranched chains with lengths from 2 to 60 carbon atoms.

13. The method according to claim 12, wherein the lubricant comprises at least one of:
oil, based on aliphatic unbranched and/or branched, alicyclic or aromatic hydrocarbon with chain lengths from 10 to 1000 carbon atoms; and
mono, di-, or polycarboxylic ester oil, based on aliphatic, unbranched or branched, alicyclic or aromatic carboxylic acid with carbon range from 3 to 100 carbon atoms, and aliphatic, unbranched or branched, alicyclic or aromatic alcohol with a carbon range from 3 to 100 carbon atoms.

14. The method according to claim 12, wherein the lubricant composition comprises an alkylammonium salt of:
a) monophosphoric acid;
b) polyphosphoric acid;
c) phosphoric acid derivative;
d) alkylphosphoric acid with chain lengths from 4 to 20 carbon atoms; or
e) phosphoric acid alkoxy derivative;
wherein the phosphoric acid or derivatives are neutralized by aliphatic, unbranched or branched or alicyclic alkylamine with chain lengths from 4 to 24 carbon atoms.

15. The method according to claim 12, wherein the lubricant composition comprises at least one of:
a) monocarboxylic acid with chain length from 2 to 100 carbon atoms;
b) polycarboxylic acid with chain lengths from 4 to 12 carbon atoms; and
c) lithium, potassium, magnesium, zinc or calcium salt of said carboxylic acids.

16. The method according to claim 12, wherein the lubricant composition comprises a lithium, potassium, magnesium, calcium, zinc, bismuth or alkylammonium salt, wherein the salt is of:
a) an inorganic acid;
b) diphosphoric acid;
c) polyphosphoric acid; or
d) phosphoric acid derivative with aliphatic, unbranched or branched, or cyclic alkyl chains with lengths from 4 to 30 carbon atoms.

17. The method according to claim 12, wherein the lubricant composition comprises at least one of:
molybdenum compound;
molybdato acid;
molybdatotungsten acid;
vanadium compound;
boric acid; and
boric acid derivative.

18. The method according to claim 12, wherein the lubricant composition comprises at least one of:
triphenylphosphorothionate;
phosphorothionate alkyl derivative with branched alkyl group from 10 to 14 carbon atoms;
carbon-nitrogen and sulphur additive;
mercaptodithiazole or derivatives or sodium salts thereof;
benzotriazole;
benzotriazole derivative;
polymeric hydroquinone derivative;
sterically hindered phenol;
sterically hindered phenol derivative;
salt of a thiocarbamic acid derivative with chain length of 4 to 12 carbons; and
salt of a dithiophosphoric acid derivative with chain lengths from 4 to 12 carbon atoms;
wherein the acids are neutralized by amine with chain lengths from 4 to 24 carbon atoms.

19. The method according to claim 12, wherein the lubricant composition is in the form of a grease or paste.

20. The method according to claim 12, wherein the two elements are selected from a ball bearing, a tapered, needle, cylindrical or spherical rolling bearing and a universal joint bearing.

21. The method according to claim 12, wherein the bearing comprises seal means for holding the lubricant inside the bearing.

22. The method according to claim 12, wherein one of the two elements is bearing rolling element and the other element is a raceway for said rolling element.

* * * * *